United States Patent [19]

Gross et al.

[11] 4,400,977

[45] Aug. 30, 1983

[54] COMBINED INDICATING APPARATUS FOR SCUBA DIVERS

[76] Inventors: Pavel Gross, Hintertrottenstr .280, CH-5326, Renigen; Jaroslav Kohout, Erbslet 373, CH-5234, Villigen, both of Switzerland

[21] Appl. No.: 234,054

[22] Filed: Feb. 12, 1981

[30] Foreign Application Priority Data

Mar. 1, 1980 [SE] Sweden ..... 1605

[51] Int. Cl.[3] ..... G01G 5/00

[52] U.S. Cl. ..... 73/432 R

[58] Field of Search ..... 73/432 R, 300, 714; 235/88 R, 88 G; 368/281

[56] References Cited

U.S. PATENT DOCUMENTS

| | | | |
|---|---|---|---|
| 3,578,241 | 5/1971 | Wombough et al. | 235/88 G |
| 3,613,354 | 10/1971 | Jenny | 368/281 X |
| 3,715,927 | 2/1973 | Grant | 73/714 |
| 3,864,977 | 2/1975 | Leemann | 73/300 X |
| 3,875,801 | 4/1975 | Bishaf | 73/714 |
| 3,919,888 | 11/1975 | Muster et al. | 73/300 X |
| 4,109,140 | 8/1978 | Etra | 235/92 MT |
| 4,327,584 | 5/1982 | Alinari | 73/432 D |

*Primary Examiner*—James J. Gill
*Assistant Examiner*—Joseph W. Roskos
*Attorney, Agent, or Firm*—Henderson & Sturm

[57] ABSTRACT

The invention concerns a decompression air supply indicator for divers which was created by expanding the function of the existing mechanical decompression meter by the inclusion of an additional scale which indicates both the time indication of the length of the decompression and the air supply necessary for the decompression.

6 Claims, 5 Drawing Figures

FIG. 2
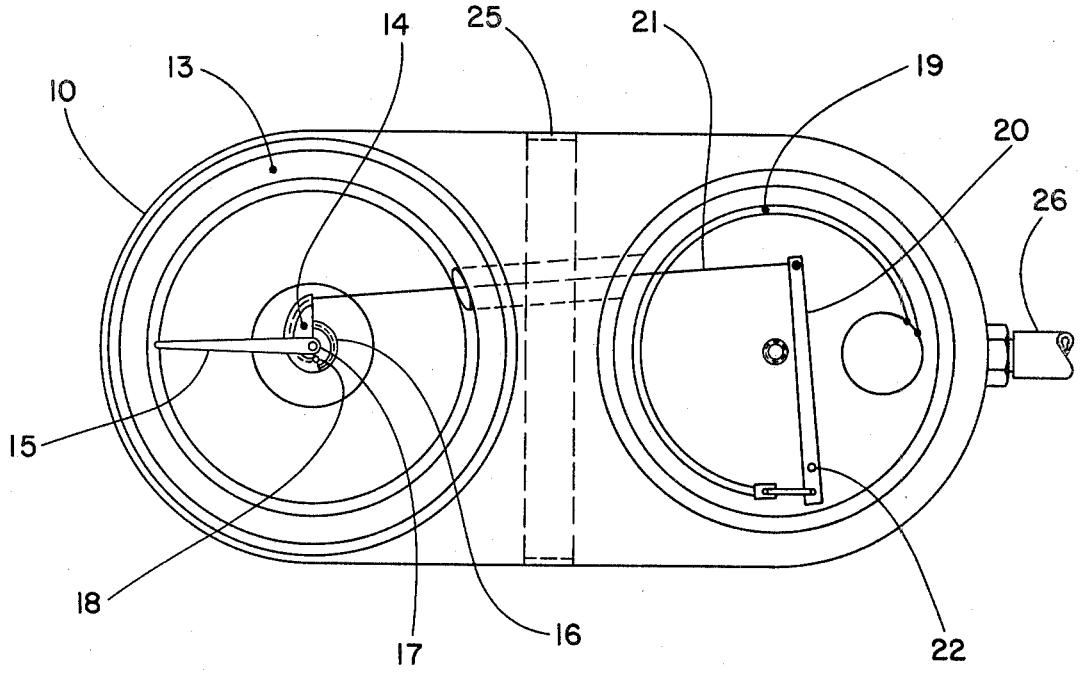
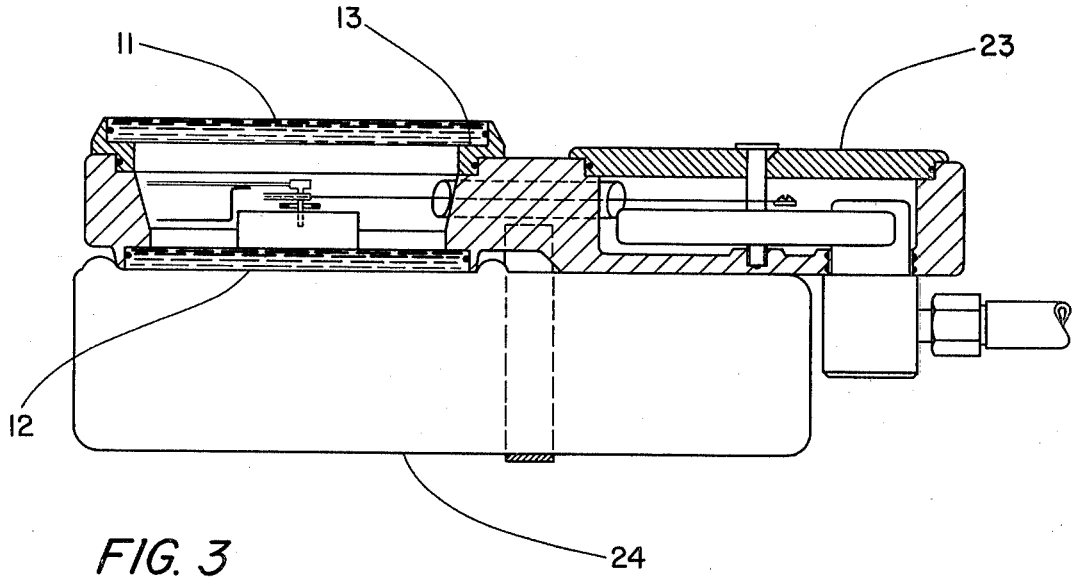
FIG. 3

COMBINED INDICATING APPARATUS FOR SCUBA DIVERS

BACKGROUND OF THE INVENTION

The principle of a decompression meter is well known in the art a mechanical system with two containers connected by a throttle and with an analog read-out or indication is especially widespread. The previously known mechanical systems indicated only the depth of the necessary decompression stage in dependency on the time, but without a readable time indication of the length of the decompression, and without additional information on the air supply necessary for the decompression.

This invention has the task of expanding the previous indications of the decompression stage including the indication of the air supply necessary for carrying out the entire decompression, and with an indication of the time needed for decompression. This additional data, which is presented in the form of an additional scale, makes it possible for the diver to read off the exact point in time of the end of the dive and the start of the decompression and to be able to monitor the decompression process better without a complicated calculation or estimation. The combination of the additional scale with the decompression meter is the decompression air supply indicator. Another task of the invention is to form a combined decompression air supply indicator which is created by integrating a compressed air monometer, the additional scale and the decompression meter.

This is achieved by the invention as follows: An existing decompression scale of a mechanical decompression meter is expanded by an additional compressed air supply scale which is calculated in advance. This scale is dependent on the decompression process and indicates the bottle pressure necessary for carrying out the decompression for each position of the decompression indicator.

The compressed air scale can consist of several scales for different breathing device bottle contents, can have a time scale and can contain correction constants for memory zone. The compressed air supply scale which can be mounted as an addition on the decompression meter is preferably constructed as an adherible plate with an indicator which can be rotated manually. Coupling the decompression meter, the compressed air storage scale and a non-linear manometer adopted to this scale into the unit producess a combined decompression air storage indicator of compact construction.

In the following detailed description of the preferred embodiment the principle of the compressed air supply scale will be described, using the drawing to show the embodiments in more detail.

BRIEF DESCRIPTION OF THE DRAWINGS

FIG. 2 shows a combined decompression air supply indicator.

FIG. 3 shows a combined decompression air supply indicator in section.

DETAILED DESCRIPTION OF THE PREFERRED EMBODIMENT

Figure 1:
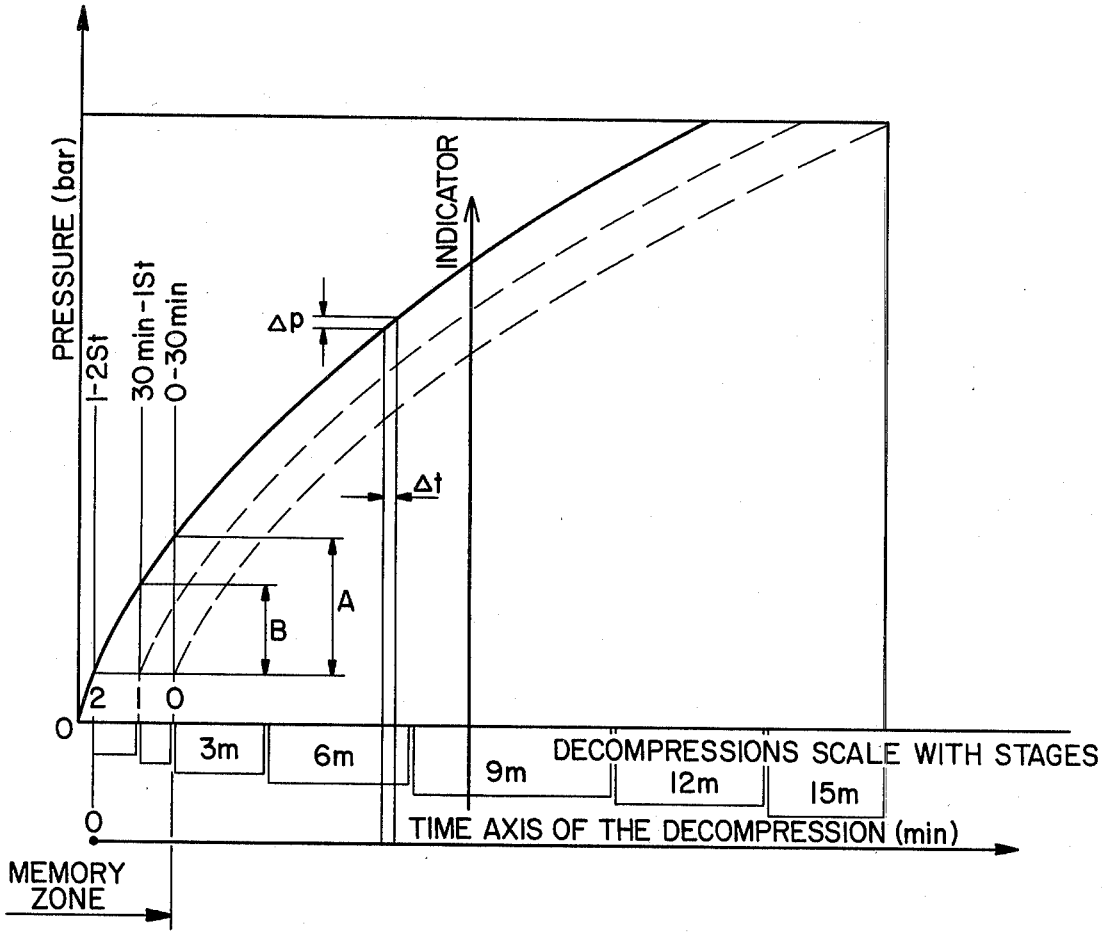
FIG. 1 is a graphic representation for describing the principle of the compressed air supply scale.

Referring now to the graph shown in FIG. 1, it is apparent from the physical principle of the known mechanical decompression meter with an indicator, that the scale of the decompression stages can be associated with a parallel time scale which is dependent on it, and which indicates for each position of the indicator of the decompression meter a corresponding decompression time. A curve can also be determined with the aid of the time scale which curve shows the bottle pressure necessary for decompression for each position of the indicator. This compressed air supply curve can be calculated as follows: A pressure drop $\Delta p$ can be calculated for each time difference $\Delta t$ on the time scale if an average consumption of breathing air Q is assumed.

$$\Delta p = (\Delta t \cdot Q \cdot h)/V$$

whereby:

$\Delta p$ = pressure drop of the air supply in the air device bottle [bar]

$\Delta t$ = any time difference [min]

Q = average consumption of breathing air [1/min]

h = absolute water pressure in the corresponding decompression stage [bar]

v = total bottle content of the breathing device [l]

The time scale (time axis) can be divided into any amounts of $\Delta t$, and the corresponding calculated $\Delta p$'s can be integrated to produce the compressed air supply curve which is typical for each bottle content of the diving device. A compressed air supply scale with values can be derived from this compressed air supply curve. The time and compressed air supply scales can be connected to the decompression scale, so that the decompression indicator shows not only the course of the decompression at any position, but also the air supply necessary for carrying out the entire decompression, as well as the time required for the same. So called memory zones are used in the most widely used decompression meters of that type mentioned here. If the underwater stay lasts longer than 30 minutes to 1 hour, the decompression does not end at point 0 (FIG. 1), but rather at point 1. If the stay lasts 1 to 2 hours, the decompression does not end until point 2. This can also be used for repeated dives. There are basically two possible ways of coupling this memory zone to the compressed air supply scale: Either three separate bottle pressure scales are used, each of which ends at the corresponding point 0, 1, 2 (shown dotted in FIG. 1) and is meant for another underwater stay; or only the scale ending in 2 is used, which is a little more reliable. This solution is simple and can be corrected in a certain practice as follows: All three curves 0, 1, 2 are parallel. If the indicator indicates point 0 at an underwater stay of less than 30 minutes, the diver would have an air supply of A. This value A is a constant number and can be subtracted at each position of the indicator after the stay time has been taken into consideration. The same thing holds true at point 1 for constant B. Both constants are written on the scales. Corrections with constants A and B are not necessary and only facilitate a better use of the air supply.

The combined decompression air supply indicator, is a coupling of the known decompression meter and the compressed air supply and time scale with the non-linear compressed air supply manometer adapted to the scale (FIGS. 2 and 3) and which consists of a housing 10 which is made water-tight with windows 11 and 12 and cover 23. The mechanism consists of a Bourdon spring 19 and a lever 20 coupled to it which can pivot on axle 22. Lever 20 is connected over a thin nylon thread 21 to a cam disk 14. The connection point is point 18. The cam disk is permanently connected to the double indicator 15 and can pivot on axle 17. Spiral spring 16 puts a pretension on thread 21. Window 11 is provided with a scale 13. Housing 10 is connected by flange 25 to decompression meter 24. The high pressure connection occurs via connection hose 26.

The indicator has a Bourdon spring (19) connected to the diving apparatus over a pressure hose (26) in a pressure-proof housing (10). The movements of the Bourdon spring are transferred over a lever (20), a thread (21), a cam disk (14) and an axle (17) to a double indicator (15). It shows the pressure in the bottle of the diving apparatus in a non-linear fashion. The bottle pressure necessary for carrying out the decompression is indicated on a scale (13) by coupling in a decompression meter.

The movement of the Bourdon spring 19 is transferred by a lever 20 which can pivot about axle 22 and by nylon thread 21 onto cam disk 14. Cam disk 14 pivots due to the rolling of thread 21 about axle 17 and transfers the desired exponential movement to double indicator 15. This exponential movement must correspond to the compressed air supply scale. Since windows 11 and 12 are transparent, the coincidence of the position of double indicator 15 with the position of the indicator of the decompression meter 24 can be compared. a precise reading is made possible by double indicator 15. During a dive double indicator 15 shows the bottle pressure in the diving device. During the dive the double indicator drops until is coincides with the indicator of decompression meter 24. Then, decompression must start. During decompression both indicators move into coincidence. The small deviation of coincidence furnish additional information on how the diver's consumption of air deviates from the assumed average consumption of breathing air Q.

Figure 4:
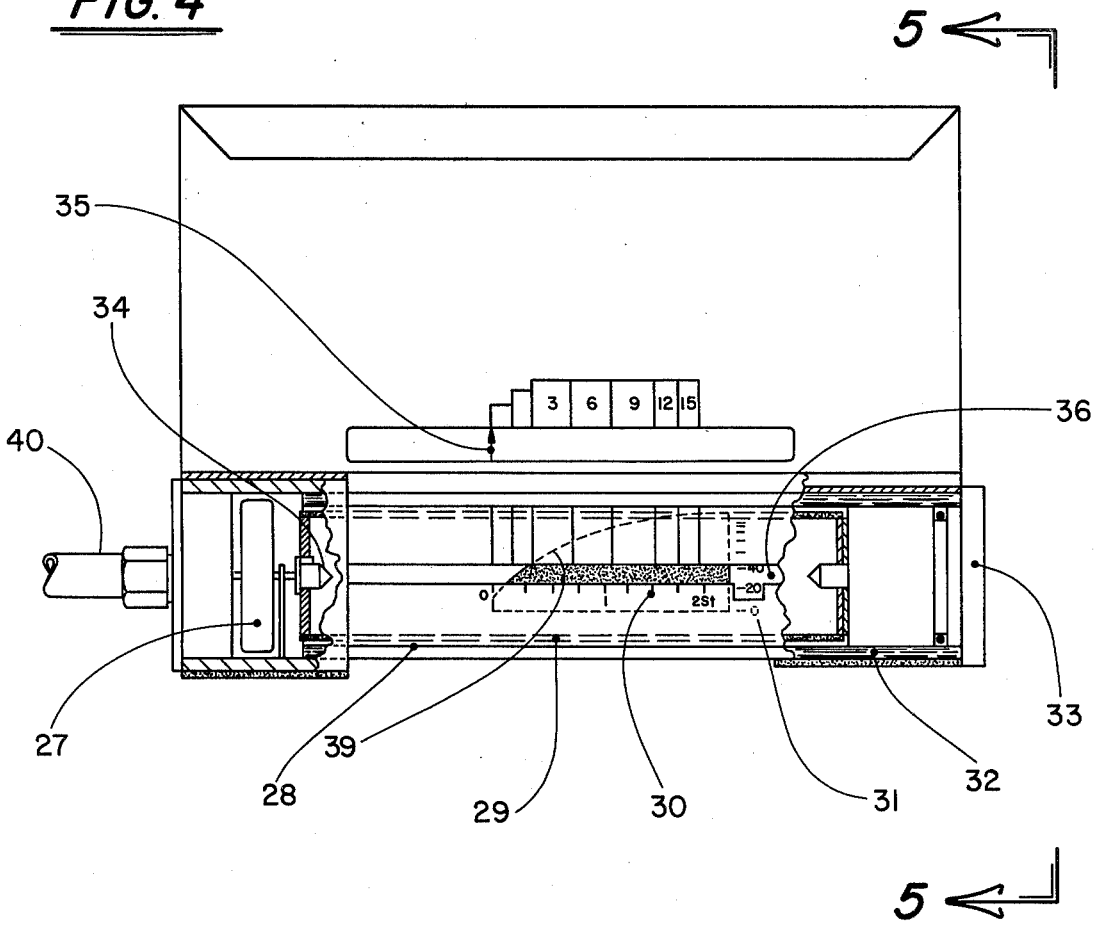
FIG. 4 and 5 shows a combined decompression air supply indicator with a straight path of the indication of decompression.
Figure 5:
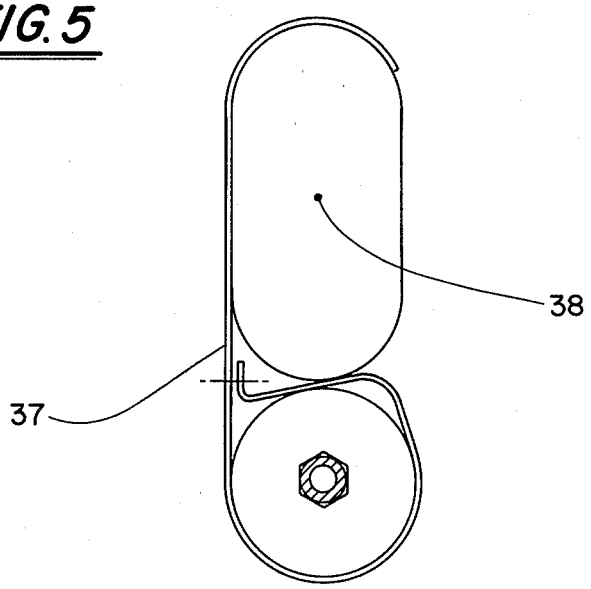

FIGS. 4 and 5 show the combined decompression air supply indicator with a straight path of the decompression indication, consisting of cylindrical, transparent housing 32 with cylindrical shield 28 attached to its inner side. This shield contains a tim scale 30 and has a slit 36. Housing 32 contains compressed air manometer 27 with a pivotable cam 34 and cylinder 29 to which compressed air supply curve 39 and compressed air supply scale 31 are attached. Housing 32 is closed by closure 33 and is connected by sheet metal holder 37 to decompression meter 38 with indication of decompression 35. The high-pressure connection occurs via a connection hose 40.

The rotary movement of manometer 27 is transferred by cam 34 to cylinder 29 with applied compressed air supply curve 39. When the part of the compressed air supply curve 39 which is visible in slit 36 is at the same level as the rising decompression indication 35, the compressed air supply necessary for carrying out the decompression is simultaneously indicated in slit 36. In addition, compressed air scale 31 continuously indicates the bottle pressure during the dive. Time scale 30 shows the length of the decompression. Cylinder 29 is exchangable and can be provided with scales suitable for any bottle content. The diver does not have to calculate the additional information on the start of the decompression, the air supply during the dive and the decompression, the time of the decompression and his own average consumption of air, which increases his safety and makes possible a better utilization of the air supply. The simple construction of the device guarantees its reliability, and the additional, adherable plate increases the usefulness of current decompression meters.

What we claim:

1. A compressed air manometer device for scuba divers for use in combination with a known decompressionmeter having a scale and indicator, wherein the compressed air manometer device comprises:

a housing connected to a source of compressed air, and having at least one transparent portion with a scale imprinted thereon, wherein the interior of the housing is visible;

an indicator mounted in said housing, and responsive to the amount of compressed air remaining in the said source of compressed air;

and means for mounting the transparent portion of the housing over the scale and indicator of said known decompressionmeter, in a superimposed relationship, whereby the scales and indicators of the combined decompressionmeter and the compressed air manometer device will be visible.

2. A device as in claim 1; wherein, the scale for the indicator of said compressed air manometer device is mathematically derived from the scale of said decompressionmeter, and the scale of said decompressionmeter and the scale of said compressed air manometer device are arranged in parallel, so that a coordinated reading of said scales gives the scuba diver an indication when he must start his decompression.

3. A device as claimed in claim 1, characterized in that the scale of said compressed air manometer device is provided with an additional decompression time scale.

4. A device as claimed in claim 1, characterized in that the scale of said compressed air manometer device has several scale divisions in accordance with a memory zone on said decompressionmeter.

5. A device as claimed in claim 1, with the decompressionmeter having a circular scale, characterized in that the compressed air manometer device has a flat housing with two parallel windows and is coaxially fitted upon said decompressionmeter, said compressed air manometer device having a double pointer driven by means of a transfer mechanism comprising a cam disk and a thread drawn over said disk and activated by a Bourdon-spring.

6. A device as claimed in claim 1, with a decompressionmeter having a straight path scale, characterized in that the compressed air manometer device also has a straight path scale, its indicator being a curve upon a rotatable cylinder, which appears behind a slit, together with a pressure indication scale.

* * * * *